US006035150A

United States Patent [19]

Domon et al.

[11] Patent Number: 6,035,150

[45] Date of Patent: Mar. 7, 2000

[54] DEVELOPING APPARATUS FOR JUDGING RESIDUAL AMOUNT OF DEVELOPING AGENT USING DETECTION MEMBER MOVING AT PREDETERMINED CYCLE

[75] Inventors: Akira Domon, Kashiwa; Yasushi Shimizu, Toride, both of Japan

[73] Assignee: Canon Kabushiki Kaisha, Tokyo, Japan

[21] Appl. No.: 09/113,349

[22] Filed: Jul. 10, 1998

[30] Foreign Application Priority Data

Jul. 14, 1997 [JP] Japan ..... 9-202602

[51] Int. Cl.[7] ..... G03G 15/08

[52] U.S. Cl. ..... 399/27; 399/254

[58] Field of Search ..... 399/27, 30, 53, 399/254, 255, 256, 258

[56] References Cited

FOREIGN PATENT DOCUMENTS 1-49067 2/1989 Japan .

OTHER PUBLICATIONS

English Abstract of British Patent 2268807, Jan. 1994.

*Primary Examiner*—Richard Moses

*Attorney, Agent, or Firm*—Fitzpatrick, Cella, Harper & Scinto

[57] ABSTRACT

A developing apparatus includes a developing container for storing a developing agent, a developing agent carrier which is disposed at the opening of the developing container, and carries the developing agent, a detection member which is disposed in the developing container and moves at a predetermined cycle, and a judging means for judging the residual amount of developing agent on the basis of changes in voltage induced at the detection member in the cycle.

7 Claims, 8 Drawing Sheets

DEVELOPING APPARATUS FOR JUDGING RESIDUAL AMOUNT OF DEVELOPING AGENT USING DETECTION MEMBER MOVING AT PREDETERMINED CYCLE

BACKGROUND OF THE INVENTION

1. Field of the Invention

The present invention relates to a developing apparatus which is used in an image forming apparatus such as an electrophotographic or electrostatic recording copying machine, printer, or the like, and develops an electrostatic latent image on an image carrier.

1. Related Background Art

An electrophotographic image forming apparatus such as a laser beam printer, copying machine, or the like, visualizes an electrostatic latent image formed on the surface of an image carrier by developing it using a particle-like developing agent, thus forming a visible image on the surface of the image carrier. The developing agent is stored in a developing container as a developing agent chamber, and is conveyed to and held on a developing agent carrier which carries the developing agent, via a developing agent convey means. The layer thickness of the developing agent held on the developing agent carrier is controlled by a developing agent layer control member, and a predetermined charge is applied to the developing agent layer. Then, the developing agent is conveyed to a developing region where the image carrier and developing agent carrier oppose each other. The developing agent on the developing agent carrier moves to an electrostatic latent image forming portion on the image carrier in the developing region to develop and visualize the latent image on the image carrier.

The developed visible image is transferred onto a transfer medium such as a paper sheet by a transfer means, and is fixed by a fixing device by heating, compression, and the like. With a series of image forming processes described above, the user can obtain a desired image.

In the above-mentioned image forming apparatus, after a certain amount of printing, the developing agent in the developing container is consumed and its residual amount becomes small. When the residual amount of developing agent becomes small or zero, the developing agent cannot be sufficiently supplied to the developing region, and an image has image forming errors such as local image omission, or the like, or cannot be printed. Hence, the image forming apparatus has a developing agent residual amount detector for warning a small residual amount of developing agent to the user before the apparatus reaches an unprintable state or the like. As a known developing agent residual amount detection method, for example, changes in the amount of developing agent in the developing container are detected as changes in capacitance, thus detecting the amount of developing agent.

The developing agent residual amount detection method for detecting the amount of developing agent by detecting changes in amount of developing agent as changes in capacitance will be explained below with reference to FIG. 10. A developing apparatus for developing an electrostatic latent image on an image carrier 30 has a developing container for storing a developing agent, and a developing sleeve 6 serving as a developing agent carrier which is disposed at a position opposing an image carrier of the developing container and carries the developing agent. An AC power supply 7 for applying a predetermined developing bias is connected to the developing sleeve 6, so that the AC power supply 7 can apply a developing bias obtained by superposing an AC voltage on a DC voltage to the developing sleeve 6.

A signal detection means 18 is disposed in the developing container at a position opposing the image carrier with a predetermined spacing. The signal detection means 18 extends parallel with the developing sleeve 6 and consists of a rod-like conductive member. The signal detection means 18 is connected to a developing agent residual amount detection circuit 140 for detecting the amount of developing agent based on a developing agent residual amount detection signal produced by a capacitance that changes in correspondence with the amount of developing agent present between the signal detection means 18, and the developing sleeve 6 applied with the developing bias. The signal detection means 18 and the developing agent residual amount detection circuit 140 build a developing agent residual amount detector for detecting the residual amount of developing agent in the developing container.

The developing agent residual amount detection circuit 140 comprises a rectifying circuit 8 for rectifying the current induced at the signal detection means 18 in correspondence with the amount of developing agent present between the signal detection means 18 and developing sleeve 6, a current-voltage conversion circuit 9 for converting a current signal generated by the rectifying circuit 8 into a voltage Vdc, a capacitor 21 connected in parallel with the developing sleeve 6 with respect to the AC power supply 7 and having a predetermined capacitance Cs, a rectifying circuit 10 connected in series with the capacitor 21, and a current-voltage conversion circuit 11 for converting a current signal generated by the rectifying circuit 10 into a voltage Vs. The circuit 140 also has a comparator 19 for comparing the output voltages Vdc and Vs from the current-voltage conversion circuits 9 and 11, and producing an output when these two voltages match each other, and a CPU 20 for receiving the detection signal from the comparator.

Using the developing agent residual amount detection circuit 140 with the above-described arrangement, the output voltage Vdc generated in correspondence with the amount of developing agent between the developing sleeve 6 and signal detection means 18 is compared with the reference voltage Vs corresponding to the capacitance Cs of the capacitor 21, and the CPU 20 performs processing, e.g., a display of a developing agent amount warning or the like using the detection signal from the comparator 19, which is generated when the two voltages Vdc and Vs match each other. By selecting a capacitor having a capacitance corresponding to the amount of developing agent to be detected, an arbitrary detection level can be set.

In response to a short developing agent amount warning, the user replenishes more developing agent to the developing container, or removes a process cartridge including the developing container from the image forming apparatus main body, and shakes and inserts the process cartridge again, so that a sufficient amount of developing agent required for development is supplied to the developing region, thereby preventing image forming errors such as local image omission or the like or an unprintable state.

The developing agent residual amount detector of such capacitive detection method is popularly used since it has a simple arrangement and can be manufactured with low cost. In order to improve the detection precision in this method, a broad dynamic range of the output voltage must be assured. For this purpose, the signal detection means is preferably disposed as close as possible to the developing sleeve.

However, when the signal detection means is too close to the developing means, it readily disturbs developing agent supply to the developing sleeve, and poses another problem, e.g., an image density drop or the like. When the signal detection means is farther from the developing sleeve, the above-mentioned image problem hardly occurs, but the dynamic range of the output voltage narrows down, thus lowering the detection precision. When the detection precision lowers, local image omission is produced before a short developing agent amount warning is produced to the user, or a short developing agent amount warning is produced even though the developing container stores a sufficient amount of developing agent. Hence, the positioning precision of the signal detection means must be managed very strictly, resulting in a small margin in design.

SUMMARY OF THE INVENTION

It is an object of the present invention to provide a developing apparatus which can accurately detect the residual amount of developing agent.

It is another object of the present invention to provide a developing apparatus which can detect the residual amount of developing agent at a plurality of levels.

It is still another object of the present invention to provide a developing apparatus comprising:

- a developing container for storing a developing agent;
- a developing agent carrier which is disposed at an opening of the developing container, and carries the developing agent;
- a detection member which is disposed in the developing container and moves at a predetermined cycle; and
- judging means for judging a residual amount of developing agent on the basis of a change in voltage induced at the detection member in the cycle.

Other objects of the present invention will become apparent from the following detailed description.

DESCRIPTION OF THE PREFERRED EMBODIMENTS

The preferred embodiments of the present invention will be explained hereinafter with reference to the accompanying drawings.

(First Embodiment)

Figure 1:
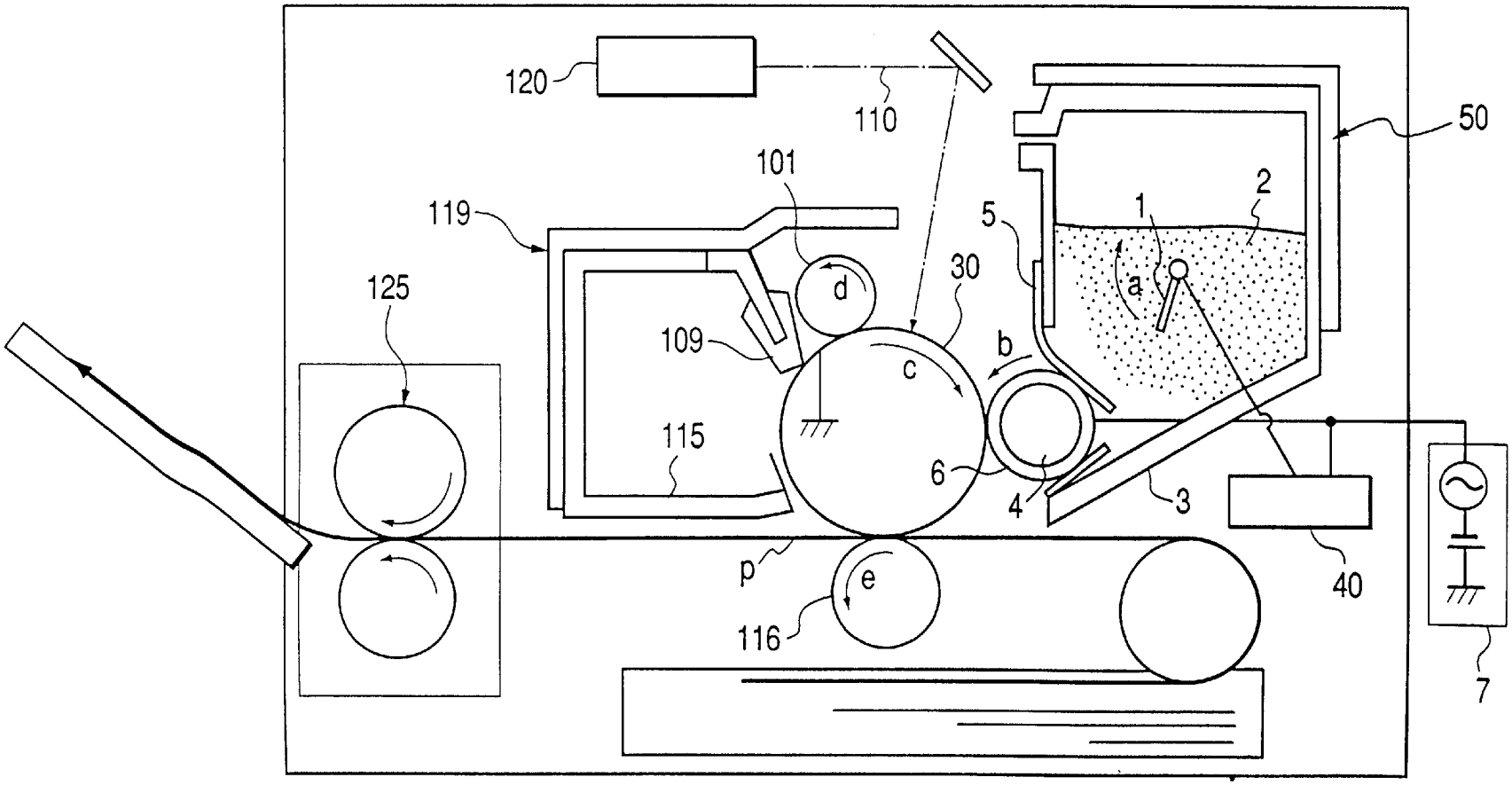
FIG. 1 is a schematic sectional view showing the arrangement of an image forming apparatus which comprises a developing agent residual amount detector according to the first embodiment of the present invention.

The first embodiment of the present invention will now be described with reference to FIGS. 1 to 5. FIG. 1 is a schematic sectional view of an image forming apparatus with a developing agent (toner) residual amount detector of this embodiment.

The image forming apparatus comprises a charging device, latent image carrier, exposure means, developing apparatus, transfer device, cleaning device, fixing device, toner residual amount detector, and the like, when it is roughly classified in terms of electrophotography processes. This embodiment will exemplify a case wherein a compact process cartridge which integrates a charging roller 101 as a charging means, a photosensitive drum 30 as a latent image carrier, a developing apparatus 50, and a cleaning device 119 is used.

In the process cartridge, the charging roller 101 for charging the surface of the photosensitive drum 30, the developing apparatus 50 for developing an electrostatic latent image formed on the photosensitive drum 30, the cleaning device 119 for recovering residual toner on the photosensitive drum 30 after the transfer process, and the like are disposed around the photosensitive drum 30.

The photosensitive drum 30 is prepared by forming an organic photosensitive layer coat on an aluminum, hollow, cylindrical base, and an electrostatic latent image is formed on its surface. The photosensitive drum 30 can rotate in the direction of an arrow "c" in FIG. 1 by a drive system (not shown) arranged on the image forming apparatus main body side.

The charging roller 101 is pressed against the photosensitive drum 30 while it receives a pressure from its two ends, and contacts the photosensitive drum 30 to have a predetermined contact width. The charging roller 101 can rotate in the direction of an arrow "d" in FIG. 1 upon rotation of the photosensitive drum 30. When a charging bias power supply (not shown) applies a predetermined bias to the charging roller 101, the roller 101 can charge the surface of the photosensitive drum 30 to a desired potential.

The developing apparatus 50 comprises a developing container 3 serving as a toner chamber which contains toner 2 using magnetic, insulative monocomponent toner for visualizing an electrostatic latent image formed on the photosensitive drum 30, a developing sleeve 6 as a hollow, cylindrical toner carrier, which is disposed in the developing container 3 at a position opposing the photosensitive drum 30, and can rotate in the direction of an arrow "b" in FIG. 1 while assuring a predetermined spacing from the photosensitive drum 30 and carrying the toner 2 on its surface, a magnet roller 4 inserted in the developing sleeve 6, an elastic rubber blade 5 serving as a toner control member which contacts the developing sleeve 6 to control the coat layer thickness of the toner 2 on the developing sleeve 6, and a rotatable toner residual amount detection member 1 disposed in the developing container 3. Note that the toner residual amount detection member 1 also serves as a toner convey means for conveying the toner 2 in the developing container 3 while stirring it toward the developing sleeve 6, and the toner 2 in the developing container 3 can be supplied to the developing sleeve 6 upon rotation of the toner residual amount detection member 1.

The developing sleeve 6 of the developing apparatus 50 is connected to an AC power supply 7, which applies a developing bias obtained by superposing a DC voltage on a predetermined AC voltage to make the toner 2 carried on the surface of the developing sleeve 6 fly to a latent image portion on the photosensitive drum 30. In this embodiment, the developing bias to be applied to the developing sleeve 6 uses an AC waveform obtained by superposing a rectangular wave of 2,000 Hz on a DC voltage of −500 V at 2,000 Vpp.

The toner residual amount detection member 1 in the developing container 3 is formed by, e.g., combining rod-like conductive members to have nearly a U-shaped section, and its base end is rotatably and axially supported by a rotation shaft which is disposed in the developing container 3 to be parallel to the developing sleeve 6. The member 1 can rotate at a predetermined cycle S. In this embodiment, the toner residual amount detection member 1 uses an aluminum rod as a nonmagnetic metal having a diameter of 2 mm.

The end portion of the rotation shaft is coupled to a driving gear (not shown) for rotation, which is arranged in the image forming apparatus main body. The toner residual amount detection member 1 makes one revolution (a radius of rotation of 20 mm) in the predetermined cycle S in the direction of the arrow "a" in FIG. 1. Note that the cycle S equals 3 (S=3) sec in this embodiment, and the center of rotation of the toner residual amount detection member 1 is spaced 30 mm from the center of the developing sleeve 6.

An electrical contact is provided to the base end of the toner residual amount detection member 1, and is electrically connected to a toner residual amount detection circuit 40. The circuit 40 detects the current value generated at the toner residual amount detection member 1 in correspondence with the residual amount of toner 2 in the developing container 3 as a toner residual amount detection signal upon application of the developing bias to the developing sleeve 6, and the amount of toner in the developing container can be detected using the toner residual amount detection signal. The toner residual amount detection member 1 arranged in the developing chamber 3, and the toner residual amount detection circuit 40 connected to the member 1 construct a toner residual amount detector.

The toner residual amount detector can detect the toner amount in the developing container by comparing a time period T1 during which the toner residual amount detection signal from the toner residual amount detection member 1 within the predetermined cycle S becomes equal to or lower than a predetermined value Vth, or a time period (S−T1), with an arbitrarily set time period Tth. Note that the toner residual amount detection circuit 40 is connected in parallel with the developing sleeve 6 with respect to the AC power supply 7, and can obtain the reference voltage Vth from the AC power supply 7 via a capacitor, rectifying circuit, current-voltage conversion circuit, and the like.

Figure 2:
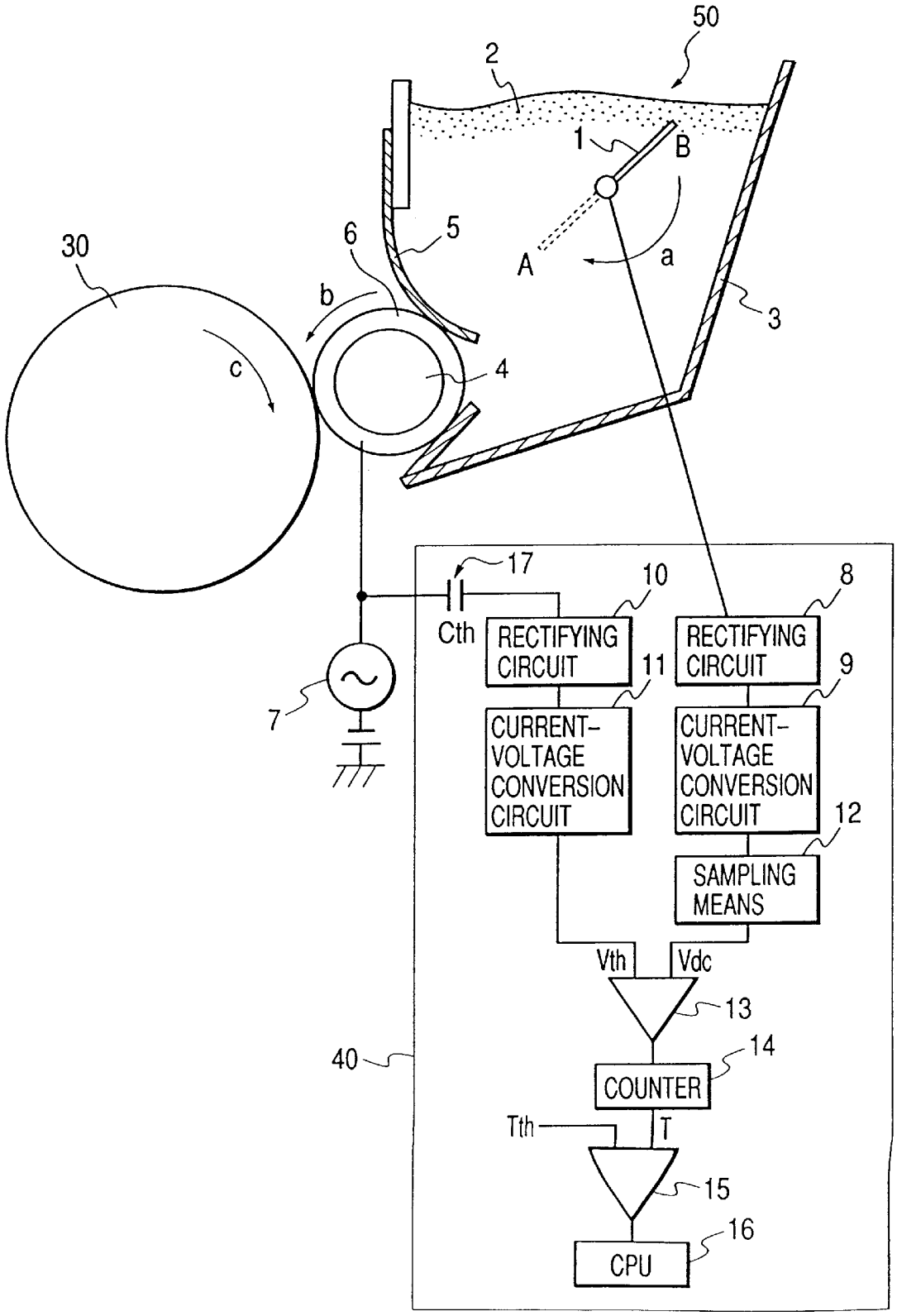
FIG. 2 is a schematic diagram showing the arrangement of the developing agent residual amount detector of the first embodiment.

As shown in FIG. 2, the toner residual amount detection circuit 40 for detecting a toner residual amount detection signal generated at the toner residual amount detection member 1 has a rectifying circuit connected in series with the toner residual amount detection member 1, a current-voltage conversion circuit 9 which is connected to the rectifying circuit 8 and outputs a predetermined voltage Vdc corresponding to the toner amount, a sampling means 12 for sampling the voltage value Vdc output from the current-voltage conversion circuit 9 at predetermined cycles, a capacitor 17 which is connected in parallel with the developing sleeve 6 with respect to the AC power supply 7 and has a capacitance Cth, a rectifying circuit 10 connected to the capacitor 17, and a current-voltage conversion circuit 11 which is connected to the rectifying circuit 10 and outputs Vth as a reference voltage. Also, the circuit 40 has a comparator 13 which is connected to the sampling means 12 and current-voltage conversion circuit 11, and generates a signal when the output voltage Vdc output from the sampling means 12 becomes equal to or lower than the reference voltage Vth, a counter 14 which repeats operations for counting the number of signals generated by the comparator 13, calculating a time period T1 based on this count value, outputting the time period T1 to a comparator 15 for each motion cycle S of the toner residual amount detection member 1, and resetting the count value, the comparator 15 for comparing the time period T1 measured by the counter 14 with a predetermined time period Tth, and generating a signal when the two time periods match each other, and a CPU 16 for detecting the signal generated by the comparator 15.

The CPU 16 can perform processing for displaying a toner amount warning on a display panel (not shown) and so on using the signal generated by the comparator 15. Note that the reference voltage Vth is determined by the capacitance of the capacitor 17, and can be arbitrarily set by changing the capacitance of the capacitor 17 in correspondence with the residual amount of toner that the user is informed of. In this embodiment, Vth is set as 1.3 V (Vth=1.3 V).

The value Tth that determines the signal transmission timing from the comparator 15 to the CPU 16 is arbitrarily set in a storage memory (not shown) in correspondence with the value Vth, the toner used, and the like, and Tth is set as 2.0 sec (Tth=2.0 sec) in this embodiment. The operations of the rectifying circuits 8 and 10, and the current-voltage conversion circuits 9 and 11 are the same those in the prior art. That is, a current generated at the toner residual amount detection member 1 is input to the rectifying circuit 8, and the current rectified by the rectifying circuit 8 is converted by the current-voltage conversion circuit 9 into a voltage value Vdc. Also, the current input to the rectifying circuit 10 and corresponding to the capacitance of the capacitor 17 is converted by the current-voltage conversion circuit 11 into a reference voltage Vth.

At the toner residual amount detection member 1, a current is induced at the leading edge of the AC waveform applied to the developing sleeve 6, and is converted into an output voltage Vdc via the rectifying circuit 8 and current-voltage conversion circuit 10. This output voltage Vdc is roughly proportional to the toner amount present between the toner residual amount detection member 1 and developing sleeve 6 and is inversely proportional to the distance between the toner residual amount detection member 1 and developing sleeve 6, and serves as a toner residual amount detection signal in the present invention.

In order to form an image by the image forming apparatus, a laser beam 110 emitted by a laser scanner unit 120 is irradiated onto the surface of the photosensitive drum 30, which has been charged to a desired charging potential by the charging roller 101, thus forming an electrostatic latent image on the surface of the photosensitive drum 30. The electrostatic latent image formed on the surface of the photosensitive drum 30 is developed by the toner 2 from the developing apparatus 50 to be visualized, and the visible toner image on the photosensitive drum 30 is transferred onto a transfer medium P by a transfer means 116.

The transfer medium P that carries the toner image is conveyed toward a fixing device 125, and the toner image on the transfer medium P is fixed by the fixing device 125 to form an image on the transfer medium P. After that, the transfer medium P is exhausted from the image forming apparatus. Residual toner 2 on the photosensitive drum 30 after the transfer process is removed by the cleaning blade 109, and is stored in a cleaning container 115. By repeating the above-mentioned processes, the user can obtain a desired image.

Figure 3:
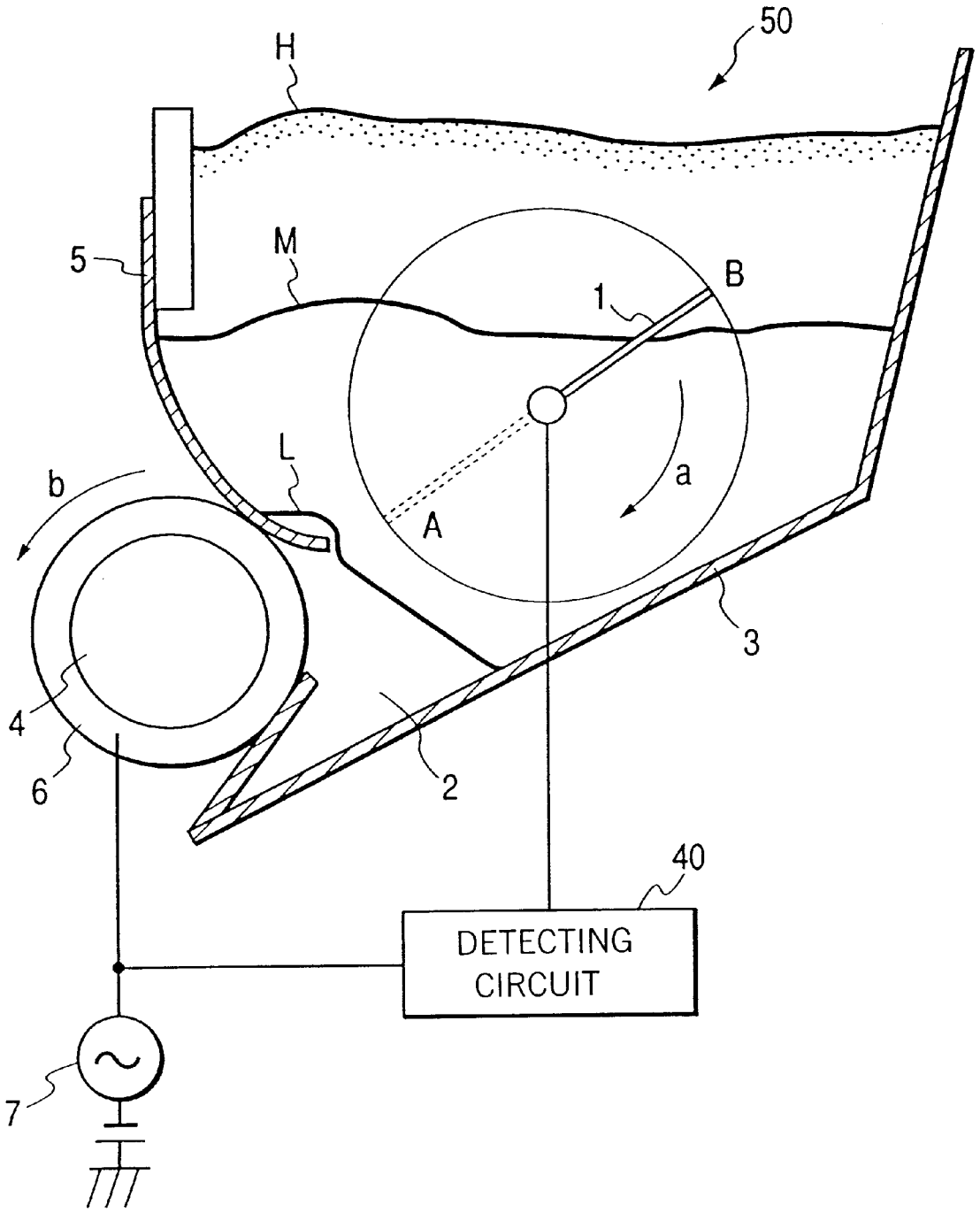
FIG. 3 is a schematic explanatory view showing changes in residual amount of developing agent in a developing container.
Figure 4:
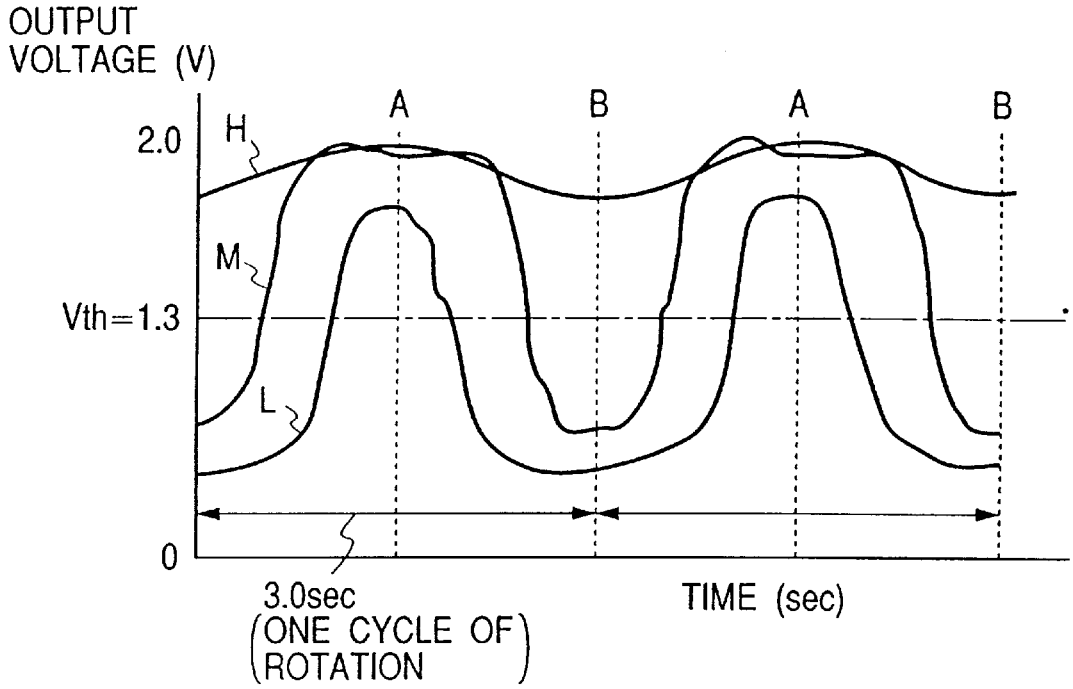
FIG. 4 is a graph showing changes in output voltage Vdc depending on the amount of developing agent in the developing container.
Figure 5:
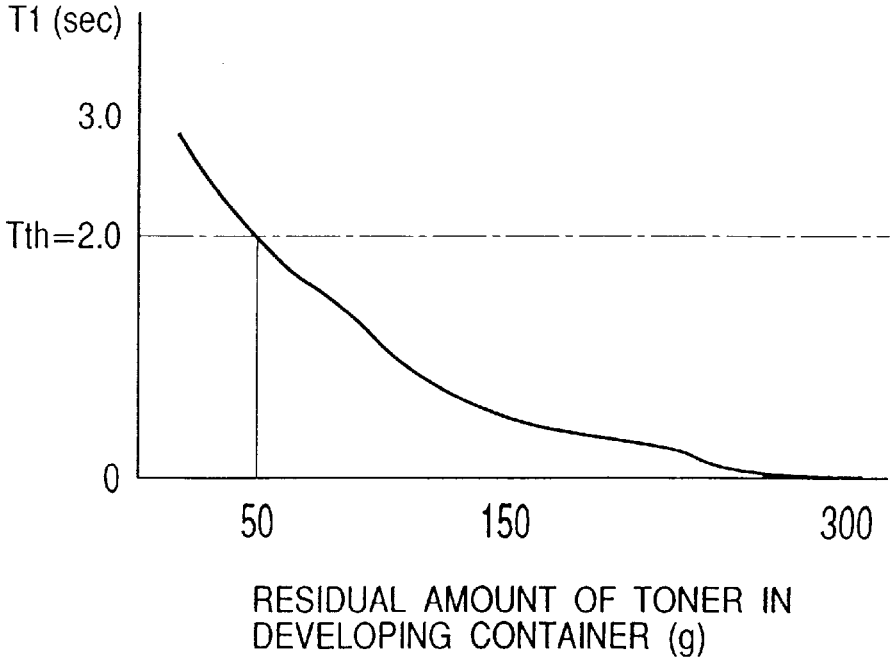
FIG. 5 is a graph showing changes in time period T1 depending on the residual amount of developing agent in the developing container.

Toner amount detection according to this embodiment will be described in detail below with reference to FIGS. 3 to 5. FIG. 3 is a schematic explanatory view showing changes in residual amount of toner in the developing container, FIG. 4 is a graph showing changes in output voltage Vdc depending on the amount of toner in the developing container, and FIG. 5 shows changes in time period T1 described above depending on the residual amount of toner in the developing container.

As shown in FIG. 3, at the beginning of use of the process cartridge and immediately after toner is replenished, the developing container 3 stores nearly 300 g of toner, which fills to a level indicated the solid curve H in FIG. 3. In this state, the toner residual amount detection member 1 rotates in the direction of the arrow "a" in FIG. 3 while it is fully buried in the toner 2. As shown in FIG. 4, when the toner residual amount detection member 1 rotates while it is fully buried in the toner 2, the output voltage Vdc shifts around 2.0 V at the rotation cycles of 3.0 sec of the toner residual amount detection member 1, as indicated by the solid curve "H" in FIG. 4, and the time period T1 during which Vth is not more than 1.3 V (Vth≦1.3 V) is 0 sec.

When the toner in the developing container 3 is consumed from about 300 g after a number of times of image formation, and the toner amount becomes approximately 150 g, the level of the toner 2 in the developing container 3 lowers to that of the solid curve "M" lower than the solid curve "H". In this state, the distal end portion of the toner residual amount detection member 1 locally falls outside the toner 2 while its distal end moves from a point "A" closest to the developing sleeve 6 to a point "B" farthest therefrom during its rotation.

When the distal end portion of the toner residual amount detection member 1 falls outside the toner 2, the capacitance between the developing sleeve 6 and toner residual amount detection member 1 abruptly becomes small, and the output voltage Vdc also drops abruptly. After that, when the toner residual amount detection member 1 is buried again in the toner 2 as its rotation progresses, the capacitance between the toner residual amount detection member 1 and developing sleeve abruptly becomes large and, hence, the output voltage Vdc rises abruptly. The output voltage Vdc becomes maximum at the point closest to the developing sleeve 6. In this manner, when the toner amount becomes small and the toner residual amount detection member 1 falls outside the toner 2 at least partially, the output voltage Vdc changes with a large amplitude in units of rotation cycles of the toner residual amount detection member 1, and becomes lower than the reference voltage Vth during a given period, as indicated by solid curve "M" in FIG. 4.

The time period T1 during which the output voltage Vdc based on the current detected from the toner residual amount detection member 1 becomes lower than the reference voltage Vth is detected by counting a signal generated by the comparator 13 every time the output voltage Vdc becomes lower than the reference voltage Vth in one cycle of the toner residual amount detection member 1. When this time period T1 becomes equal to or longer than the predetermined time period Tth, the comparator 15 generates a signal to the CPU 16, thus generating a predetermined toner residual amount warning. In this embodiment, when the toner amount is nearly 150 g, T1 is approximately 1.0 sec, and is shorter than 2.0 sec set as Tth. Hence, no warning is produced.

As shown in FIG. 3, when the toner 2 is further consumed and the toner amount reaches about 50 g, the level of the toner 2 lowers to the position of a solid curve "L" lower than the solid curve "M". In this state, the toner residual amount detection member 1 rotates without being buried in the toner 2. Hence, both the maximum and minimum values of the output voltage Vdc become small, and T1 is further prolonged to 2.0 sec. This value matches Tth=2.0 sec set in advance. At this time, the comparator 15 generates a signal to the CPU 16, which generates a small toner amount warning to the user by predetermined operation. With this warning, the user replenishes toner in the developing container 3, shakes and reuses the process cartridge including the developing container 3, or exchanges the process cartridge with a new one, thus preventing local image omission and the like.

As described above, in this embodiment, the output voltage Vdc generated based on the current induced by the rotating toner residual amount detection member is always monitored, and when the time period T1 during which the output voltage Vdc becomes equal to or lower than the predetermined output value Vth in one rotation cycle of the toner residual amount detection member becomes equal to or longer than the predetermined time period Tth, a small toner amount warning is produced to call attention of the user. Hence, since the toner residual amount detection member is rotating, a larger margin for positioning precision of the toner residual amount detection member can be assured and the member is hardly influenced by electrical instantaneous noise as compared to when the detection member stands still. For this reason, detection errors are unlikely to occur, and the toner amount detection precision can be stabilized and improved.

Since the toner residual amount detection member moves inside the developing container, the toner residual amount can be detected at more positions than the member is fixed in position. Hence, toner residual amount detection that accurately reflects the remaining amount of toner in the developing container can be done.

In this embodiment, when the time period T1 during which the output voltage Vdc of the toner residual amount detection member becomes equal to or lower than the predetermined output value Vth in one rotation cycle of the toner residual amount detection member becomes equal to or longer than the predetermined time period Tth, a small toner amount warning is produced to call attention of the user. Conversely, a small toner amount warning may be produced when a time period T1 during which the output voltage Vdc of the toner residual amount detection member becomes equal to or higher than the predetermined output value Vth in one rotation cycle becomes equal to or shorter than the predetermined time period Tth.

Also, the residual amount of toner may be detected by comparing the time period obtained by subtracting the time period T1 or T2 from the cycle S of the toner residual amount detection member with the predetermined value Tth. In this case, for example, when the time period T1 during which the output voltage Vdc of the toner residual amount detection member becomes equal to or lower than the predetermined output value Vth in one rotation cycle is used, a small residual amount warning is produced when the time period S−T1 becomes equal to or shorter than the predetermined time period Tth. When the time period T2 during which the output voltage Vdc of the toner residual amount detection member becomes equal to or higher than the predetermined output value Vth in one rotation cycle is used, a small residual amount warning is produced when the time period (S−T2) becomes equal to or longer than the predetermined time period Tth.

(Second Embodiment)

The second embodiment of the present invention will be described below with reference to FIGS. 6 and 7. In this embodiment, a plurality of detection levels Tth for a time period T1 during which an output voltage Vdc becomes equal to or lower than an arbitrary value Vth are set in place of the single level in the first embodiment, and a plurality of comparators are inserted between the CPU and counter in correspondence with the plurality of levels Tth, so that a signal can be transmitted to the CPU stepwise in correspondence with the residual amount of toner, thus sequentially informing the user of the amount of toner that remains in the developing container. Since other arrangements are the same as those in the first embodiment, a repetitive description thereof will be avoided.

Figure 6:
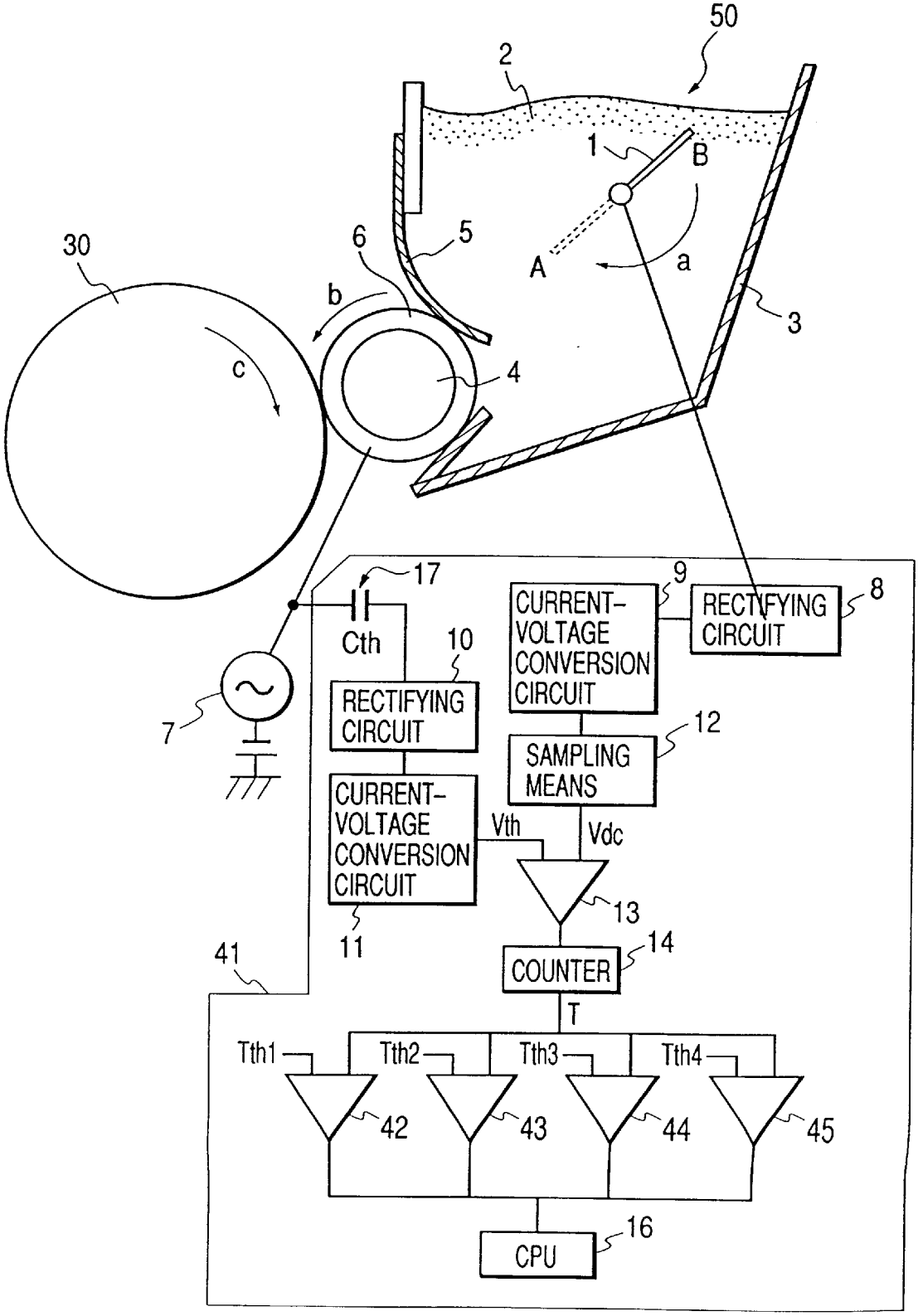
FIG. 6 is a schematic diagram showing the arrangement of the developing agent residual amount detector according to the second embodiment of the present invention.
Figure 7:
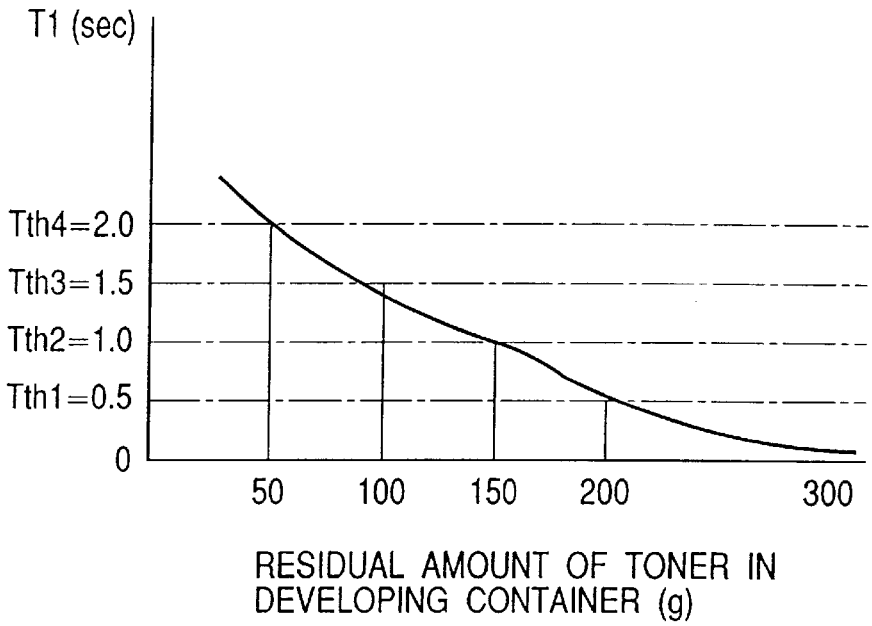
FIG. 7 is a graph showing the relationship between the amount of developing agent present in the developing container, and the time period T1.

FIG. 6 is a schematic diagram showing the arrangement of the toner residual amount detector according to this embodiment. As shown in FIG. 6, a plurality of levels Tth are set in a memory element (not shown), and a plurality of comparators corresponding to these levels Tth are parallelly inserted between a counter 14 and CPU 16 in a toner residual amount detection circuit 41. One of the plurality of levels Tth is input to each comparator. When the time period T1 measured by the counter 14 matches one of the plurality of levels Tth, a predetermined comparator generates a signal to the CPU 16.

More specifically, Tth1=2.0 sec, Tth2=1.5 sec, Tth3=1.0 sec, and Tth4 =0.5 sec are respectively set. In the toner residual amount detection circuit 41, comparators 42, 43, 44, and 45 corresponding to the set four levels Tth are arranged, and are connected to the counter. The comparator 42 receives Tth1; the comparator 43 Tth2; the comparator 44 Tth3; and the comparator 45 Tth4, so that each comparator receives one of the plurality of levels Tth.

When the time period T1 measured by the counter is input to the four comparators and matches one of Tth1, Tth2, Tth3, and Tth4, the comparator that has received Tth matching T1 transmits a signal to the CPU 16, which informs the user of the residual amount of toner corresponding to the comparator that transmitted the signal. Since other arrangements, i.e., the developing apparatus 50, toner residual amount detection member 1, the rectifying circuits 8 and 10 and current-voltage conversion circuits 9 and 11 in the toner residual amount detection circuit, and the like are the same as those in the first embodiment, a detailed description thereof will be omitted.

Residual amount detection of toner by the toner residual amount detector of this embodiment will be explained below with reference to FIG. 7. FIG. 7 is a graph showing the relationship between the amount of toner present in the developing container, and the time period T1. In this embodiment, assume that the toner amount is displayed in five levels, and toner amount level 5 is displayed on a display device (not shown) by the CPU 16 at the beginning of use of the image forming apparatus (the developing container is full of toner). As the toner amount level becomes smaller, the toner amount also becomes smaller.

When the toner amount in the developing container 3 has become nearly 200 g after a number of times of image formation from the state of toner amount level 5, the time period T1 during which the output voltage Vdc based on the detection current becomes lower than the reference voltage Vth in the rotation cycle of the toner residual amount detection member 1 becomes T=0.5 sec. At this time, the comparator 42 that has received Tth1=0.5 sec generates a signal, and toner amount level 4 is displayed on a toner amount display panel.

Similarly, when the amount of toner 2 has decreased to about 150 g and T1=1.0 sec has been reached, toner amount level 3 is displayed on the toner amount display panel; when the amount of toner 2 has decreased to about 100 g and T1=1.5 sec has been reached, toner amount level 2 is displayed; and when the amount of toner 2 has decreased to about 50 g and T1=2.0 sec has been reached, toner amount level 1 is displayed.

When toner amount level 1 is displayed, the user replenishes toner in the developing container 3, shakes and reuses the process cartridge including the developing container 3, or exchanges the process cartridge with a new one.

To restate, the toner residual amount detector of this embodiment always monitors the output voltage Vdc of the toner residual amount detection member, and compares the time period T1 during which the output voltage Vdc becomes equal to or lower than the predetermined output value Vth in one rotation cycle of the toner residual amount detection member with a plurality of predetermined time periods Tth. Consequently, it can inform the user of the residual amount of toner in the developing container in a plurality of levels. Also, since the toner residual amount detection member is rotating, a larger margin for positioning precision of the toner residual amount detection member can be assured and the member is hardly influenced by electrical instantaneous noise as compared to when the detection member stands still. For this reason, an image forming apparatus which is free from any detection errors, can very accurately inform the user of the toner amount stepwise, and has high useability can be provided.

In this embodiment, a small toner amount warning may be produced when a time period T2 during which the output voltage Vdc of the toner residual amount detection member becomes equal to or higher than the predetermined output value Vth in one rotation cycle becomes equal to or shorter than the predetermined time period Tth, as in the first embodiment.

Also, the residual amount of toner may be detected by comparing the time period obtained by subtracting the time period T1 or T2 from the cycle S of the toner residual amount detection member with the predetermined value Tth. In this case, for example, when the time period T1 during which the output voltage Vdc of the toner residual amount detection member becomes equal to or lower than the predetermined output value Vth in one rotation cycle is used, a small residual amount warning is produced when the time period (S−T1) becomes equal to or shorter than the predetermined time period Tth. When the time period T2 during which the output voltage Vdc of the toner residual amount detection member becomes equal to or higher than the predetermined output value Vth in one rotation cycle is used, a small residual amount warning is produced when the time period (S−T2) becomes equal to or longer than the predetermined time period Tth.

(Third Embodiment)

Figure 9:
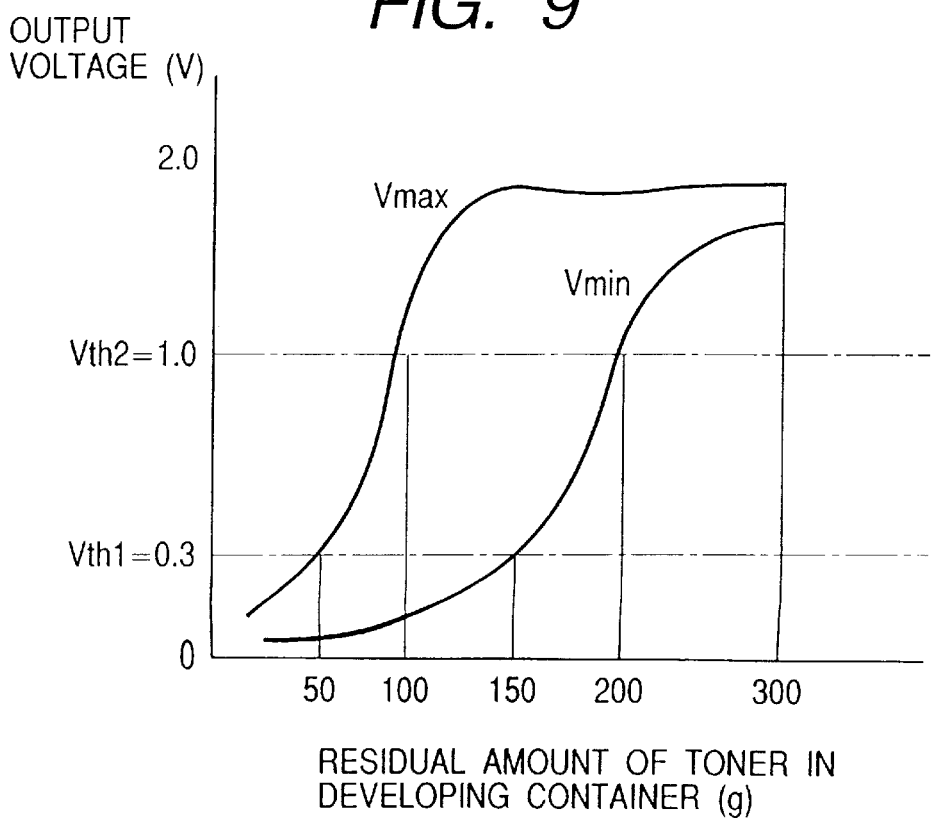
FIG. 9 is a graph showing changes in maximum value Vmax and minimum value Vmin depending on the residual amount of developing agent.
Figure 8:
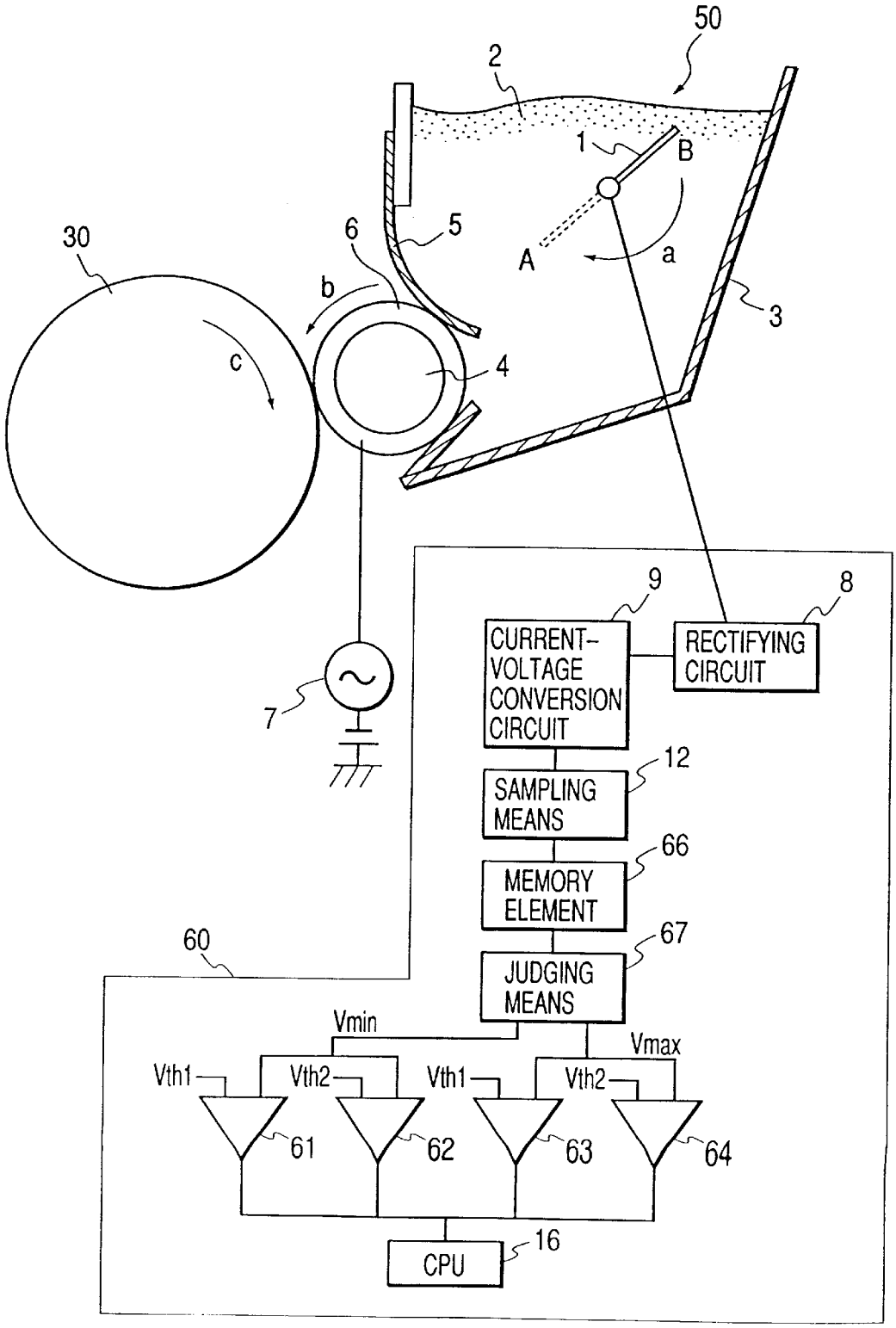
FIG. 8 is a schematic diagram showing the arrangement of the developing agent residual amount detector according to the third embodiment of the present invention.
Figure 10:
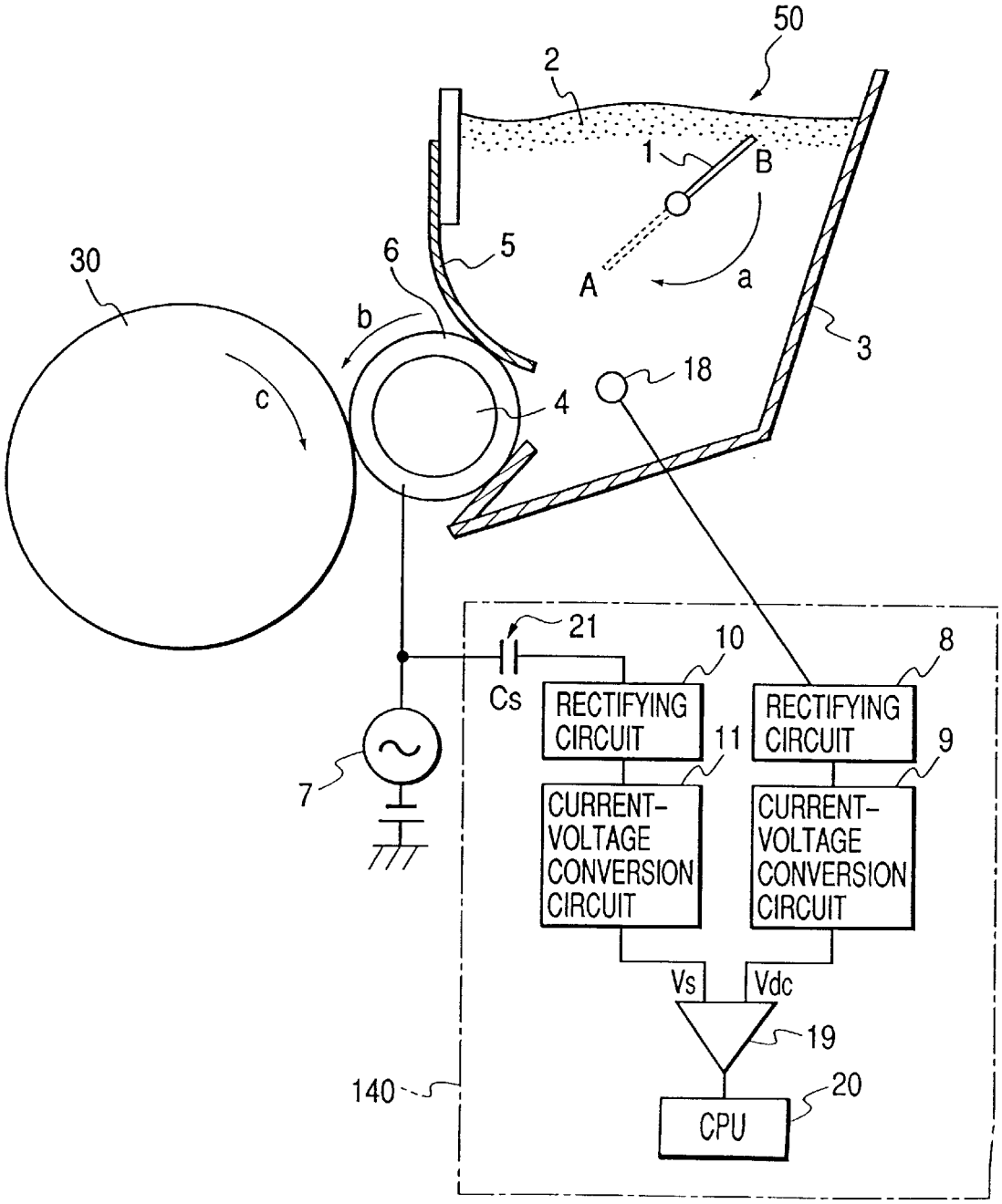
FIG. 10 is a schematic diagram showing the arrangement of a conventional developing agent residual amount detector.

The third embodiment of the present invention will be described below with reference to FIGS. 8 and 9. In this embodiment, the minimum and maximum values of the output voltage Vdc from a toner residual amount detection member 1 are detected in one rotation cycle of the toner residual amount detection member, and are compared with a plurality of detection levels Vth set in the toner residual amount detection circuit, thus informing the user of the amount of toner remaining in a developing container as needed. Also, this embodiment is characterized in that it does not require any circuit portion for obtaining the reference voltage, i.e., the circuit formed from the capacitor connected in parallel with the developing sleeve with respect to the AC power supply for applying a developing bias to the developing sleeve and having the predetermined capacitance Cs, the rectifying circuit connected in series with the capacitor, and the current-voltage conversion circuit for converting a current signal generated by the rectifying circuit into a voltage, which are included in the toner residual amount detection circuit of each of the above embodiments. Since other arrangements are the same as those in the first embodiment, a repetitive description thereof will be avoided.

The arrangement of a toner residual amount detection circuit in a toner residual amount detector will be explained below with reference to FIG. 8, which is a schematic diagram showing the arrangement of the toner residual amount detector of this embodiment. The toner residual amount detector of this embodiment comprises a toner residual amount detection member 1 and toner residual amount detection circuit 60, and the toner residual amount detection member 1 is connected to a rectifying circuit 8 in the toner residual amount detection circuit 60. The toner residual amount detection circuit 60 comprises the rectifying circuit 8, a current-voltage conversion circuit 9, a sampling means 12, a memory element 66, a judging means 67, four comparators 61, 62, 63, and 64, and a CPU 16.

A current is induced at the toner residual amount detection member 1 in correspondence with the amount of toner present between a developing sleeve 6 and the toner residual amount detection member 1, and is converted into an output voltage Vdc via the rectifying circuit 8 and current-voltage conversion circuit 9 arranged in the toner residual amount detection circuit 60. The output voltage Vdc is sampled by the sampling means 12, and is stored in the memory element 66 in correspondence with only one rotation cycle of the toner residual amount detection member 1. The memory contents are updated for each rotation cycle S of the toner residual amount detection member 1.

The judging means 67 connected to the memory element 66 judges maximum and minimum values Vmax and Vmin of the output voltage Vdc stored in the memory element 66, and outputs the maximum value Vmax to the comparators 63 and 64, and the minimum value Vmin to the comparators 61 and 62. The judging means 67 judges the maximum and minimum values Vmax and Vmin of the output voltage Vdc stored in the memory element 66 for each rotation cycle S of the toner residual amount detection member 1, and outputs Vmax and Vmin for each rotation cycle of the toner residual amount detection member 1.

Each of the four comparators 61, 62, 63, and 64 receives one of a plurality of levels Vth pre-stored in a memory element (not shown), and transmits a signal "t" the CPU 16 when the maximum or minimum value Vmax or Vmin from the judging means 67 matches Vth. More specifically, the comparator 61 receives the minimum value Vmin from the judging means 67, and Vth1; the comparator 62 the minimum value Vmin from the judging means 67, and Vth2; the comparator 63 the maximum value Vmax from the judging means 67, and Vth1; and the comparator 64 the maximum value Vmax from the judging means 67, and Vth2.

The comparators 61 and 62 which received Vmin from the judging means 67 compare Vmin with Vth1 or Vth2 input thereto, and generate a signal when the two values match each other. The comparators 63 and 64 which received Vmax from the judging means 67 compare Vmin with Vth1 or Vth2 input thereto, and generate a signal when the two values match each other. Vth1 and Vth2 can be arbitrarily set. In this embodiment, Vth1 is set as 1.0 V (Vth1=1.0 V) and Vth2 is set as 0.3 V (Vth2=0.3 V).

Upon reception of a signal from one of the four comparators 61, 62, 63, and 64, the CPU 16 can display a toner amount level corresponding to the comparator that transmitted the signal on a toner amount display panel or the like. In this way, the detector can inform the user of five different toner amount levels including a state wherein no signal is received from the comparators.

Toner amount detection by the toner residual amount detector of this embodiment will be explained below with reference to FIG. 9 which is a graph showing changes in maximum and minimum values Vmax and Vmin depending on the residual amount of toner. At the beginning of use of a process cartridge, 300 g of toner 2 are present in the developing container 3.

At this time, both Vmax and Vmin shift with values as large as about 2.0 V. In this state, no signal is transmitted from the four comparators, and toner amount level 5 is displayed on the toner amount display panel. As the toner amount level becomes smaller, the toner amount also becomes smaller.

When the toner amount decreases after a number of times of image information from the state of toner amount level 5, Vmin begins to drop. When the toner amount has reached about 200 g, Vmin becomes 1.0 V. This value Vmin matches Vth1=1.0 V set in advance, and the comparator 61 transmits a signal to the CPU.

Upon reception of the signal from the comparator 61, the CPU 16 issues a command to display toner amount level 4 on the toner amount display panel (not shown). When the toner amount further decreases and has reached approximately 150 g, Vmin further drops, and becomes 0.3 V. Since this value Vmin matches Vth2=0.3 V set in advance, the comparator 62 transmits a signal to the CPU 16. Upon reception of the signal from the comparator 62, the CPU 16 commands to display toner amount level 3 on the toner amount display panel.

After that, when the amount of toner 2 decreases after a number of times of image formation, Vmax begins to drop. When the amount of toner 2 has reached 100 g, Vmax becomes 1.0 V. Since this value matches Vt1=1.0 V, the comparator 63 transmits a signal to the CPU 16. Upon reception of this signal, the CPU 16 displays toner amount level 2 on the toner amount display panel. When the amount of toner 2 further decreases, Vmax drops accordingly. When the amount of toner 2 has reached 50 g, Vmax matches Vth2=0.3 V. At this time, the comparator 64 issues a signal to the CPU 16. Upon reception of this signal, the CPU 16 displays toner amount level 1 on the toner amount display panel. Upon confirmation of toner amount level 1, the user replenishes toner in the developing container 3, shakes and reuses the process cartridge including the developing container 3, or exchanges the process cartridge with a new one, thus preventing local image omission and the like.

To recapitulate, according to this embodiment, the output voltage Vdc of the toner residual amount detection member is always monitored, and the maximum and minimum values of the predetermined output value in one rotation cycle of the toner residual amount detection member are compared with a plurality of predetermined values, thus informing the user of a plurality of toner amount levels. Hence, according to the present invention, an image forming apparatus with high useability can be provided as in the above embodiments.

In each of the above embodiments, the toner residual amount detection member is rotating. However, the present invention is not limited to rotation, but the toner residual amount detection member need only move cyclically (for example, the member may linearly reciprocally move). The toner residual amount detection member also serves as a toner convey means. However, the present invention is not limited in this manner. For example, the toner residual amount detection member may be disposed in the developing container independently of the toner convey means, or may also serve as a stirring means for stirring toner.

The embodiments of the present invention have been described. However, the present invention is not limited to these embodiments, and various other modifications may be made within the spirit and scope of the invention.

What is claimed is:

1. A developing apparatus comprising:

a developing container for storing a developing agent;

a developing agent bearing member disposed at an opening of said developing container, for bearing the developing agent;

a detection member disposed in said developing container and moving in a predetermined cycle; and judging means for judging a residual amount of developing agent on the basis of a change in voltage induced at the detection member in the cycle.

2. An apparatus according to claim 1, wherein said detection member agitates the developing agent.

3. An apparatus according to claim 1, further comprising:

applying means for applying a developing bias of a predetermined frequency to said developing agent bearing member.

4. An apparatus according to claim 1, wherein said judging means judges the residual amount of developing agent on the basis of a time period during which the voltage induced at said detection member becomes not more than a predetermined value.

5. An apparatus according to claim 1, wherein said judging means judges the residual amount of developing agent on the basis of a time period during which the voltage induced at said detection member becomes not less than a predetermined value.

6. An apparatus according to claim 1, wherein said judging means judges the residual amount of developing agent on the basis of maximum and minimum values of the voltage induced at said detection member.

7. An apparatus according to claim 1, wherein said judging means judges a present state of developing agent in a plurality of steps.

* * * * *